US005820138A

United States Patent [19]

Hajat Dost Sani

[11] Patent Number: 5,820,138

[45] Date of Patent: Oct. 13, 1998

[54] CONVERTIBLE IN-LINE ROLLER SKATES

[76] Inventor: Bigan Hajat Dost Sani, 383 Canal St., New York, N.Y. 10013

[21] Appl. No.: 641,276

[22] Filed: Apr. 30, 1996

[51] Int. Cl.[6] ..... A63C 17/22

[52] U.S. Cl. ..... 280/7.13; 36/115; 280/11.22; 280/11.27

[58] Field of Search ..... 36/114, 115; 280/7.1, 280/7.12, 7.13, 11.22, 11.27, 11.28

[56] References Cited

U.S. PATENT DOCUMENTS

| | | | |
|---|---|---|---|
| 2,095,942 | 10/1937 | Wetterstrand | 280/7.13 |
| 4,008,901 | 2/1977 | Conn | 280/7.13 |
| 4,932,675 | 6/1990 | Olson et al. | 280/11.27 X |
| 5,507,506 | 4/1996 | Shadroui | 280/11.22 |

*Primary Examiner*—Brian L. Johnson
*Assistant Examiner*—Michael Mar
*Attorney, Agent, or Firm*—Londa and Traub LLP

[57] ABSTRACT

An in-line roller skate and shoe combination includes a shoe having a sole with at least one recess therein opening downward to the bottom face. The bottom face of the sole is generally flat and free of protrusions to permit walking when the wheel support frame is not engaged. A wheel support frame has at least two in-line wheels rotatably secured to a base of the frame. The recess forms a longitudinal track running from a region of the sole adjacent a toe end of the sole towards and opening out of a heel end of the sole and continuing, curving upwards along the back of the shoe. A wheel support frame assembly has wheels residing rotatably, each within a separate wheel housing, with each wheel housing being linked, preferably by a flexible wire. An upper portion of each wheel housing is shaped to conform to the track so as to be able to ride along said track while being supportingly retained therein. The wheel support frame may be slid along the track toward the back of the shoe, and then upwards along the back of the shoe to a stowed position.

4 Claims, 2 Drawing Sheets

CONVERTIBLE IN-LINE ROLLER SKATES

BACKGROUND OF THE INVENTION

The present invention relates to in-line roller skates. More particularly, the invention relates to in-line roller skates which have a means for retainingly relocating the skate wheels to thereby convert the shoe portion into a walking shoe.

Currently, in-line roller skates comprise a generally rigid shoe or boot portion. A set of at least two, but preferably three or four, rubber or hard plastic wheels are rotatably fixed to a support frame, which frame is in turn fixed to the bottom of the shoe. The wheels are set radially along a straight line from front to back of the shoe. A major drawback exists, however, for the skater who wishes to skate for long distances, or for a combined purpose. In particular, if the person also wishes to engage on the same trip in activities which requires walking, rather than skating, he or she must always be carrying with them an extra pair of walking shoes to replace the skates, or vice versa.

Accordingly, it is an object of the present invention to provide in-line roller skates which are convertible to walking shoes.

SUMMARY OF THE INVENTION

A skate/shoe combination of the invention relates to a shoe having a sole with at least one recess therein opening downward to the bottom face. The recess forms a longitudinal track running from a region of the sole adjacent a toe end of the sole towards and opening out of a heel end of the sole, and preferably continuing, curving upwards along the back of the shoe. A wheel support frame assembly has at least two in-line wheels each residing rotatably within a wheel housing, with each wheel housing being linked, preferably by a flexible wire. An upper portion of each wheel housing is shaped to conform to the track so as to be able to ride along said track while being supportingly retained therein. When skating is no longer desired, the wheel support frame may be slid along the track toward the back of the shoe, and then upwards along the back of the shoe to a stowed position. Normal walking may be then be accomplished.

DETAILED DESCRIPTION OF THE INVENTION

Figure 1:
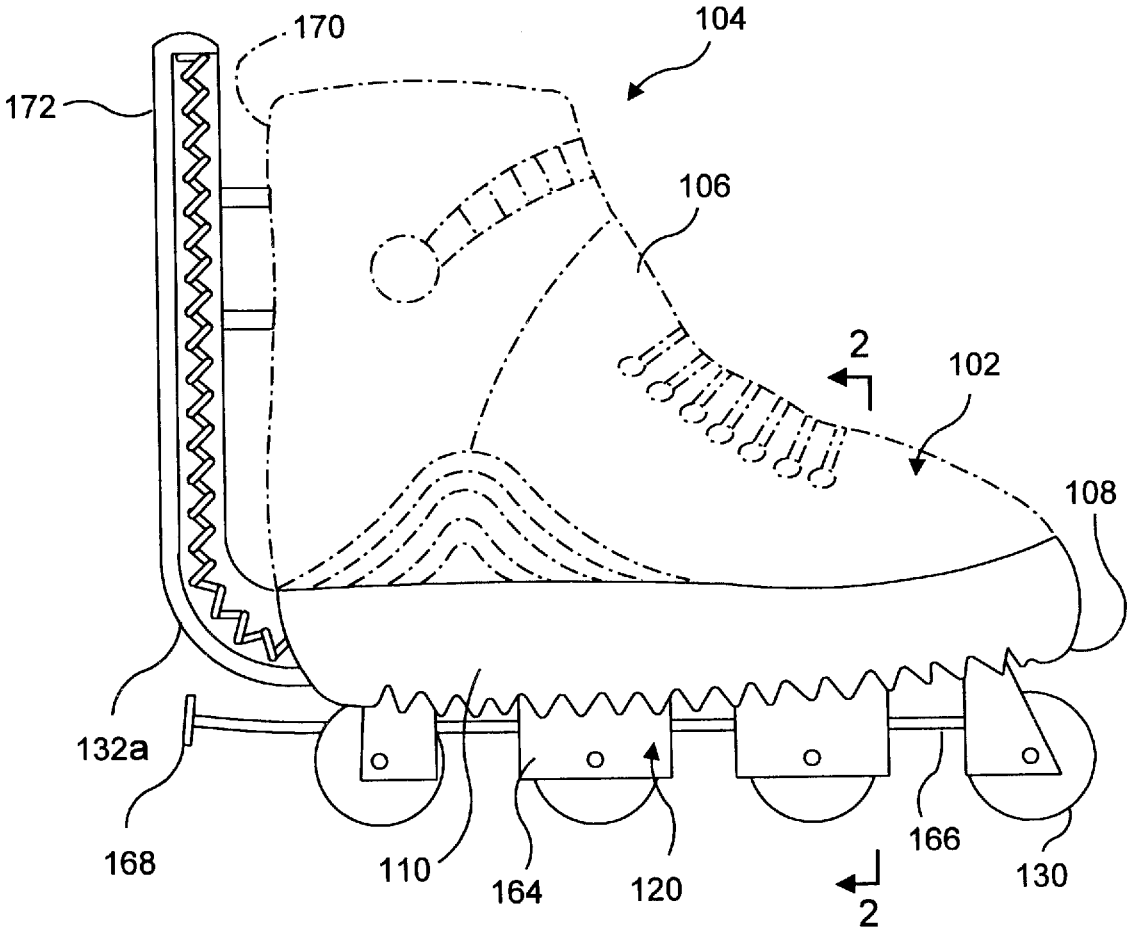
FIG. 1 is a side plan view of a shoe/skate combination of a second embodiment of the invention, with wheel frame assembly in the deployed position.
Figure 2:
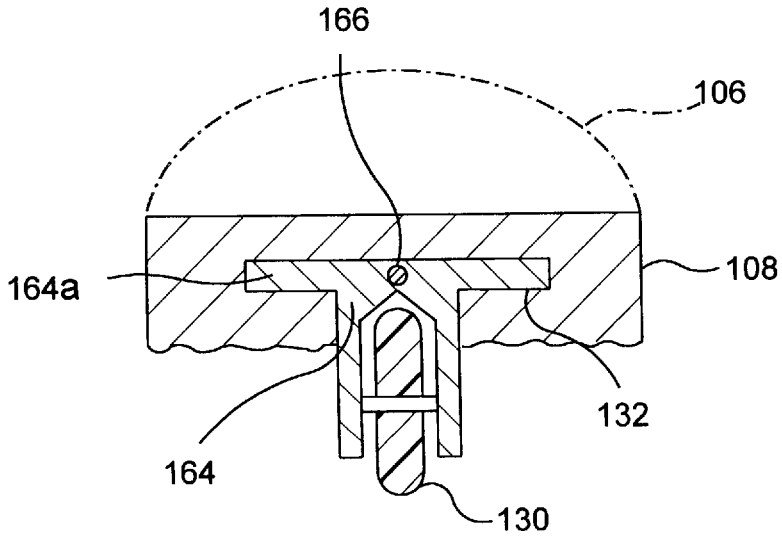
FIG. 2 is a cross-section view of FIG. 1 taken along line 2—2.
Figure 3:
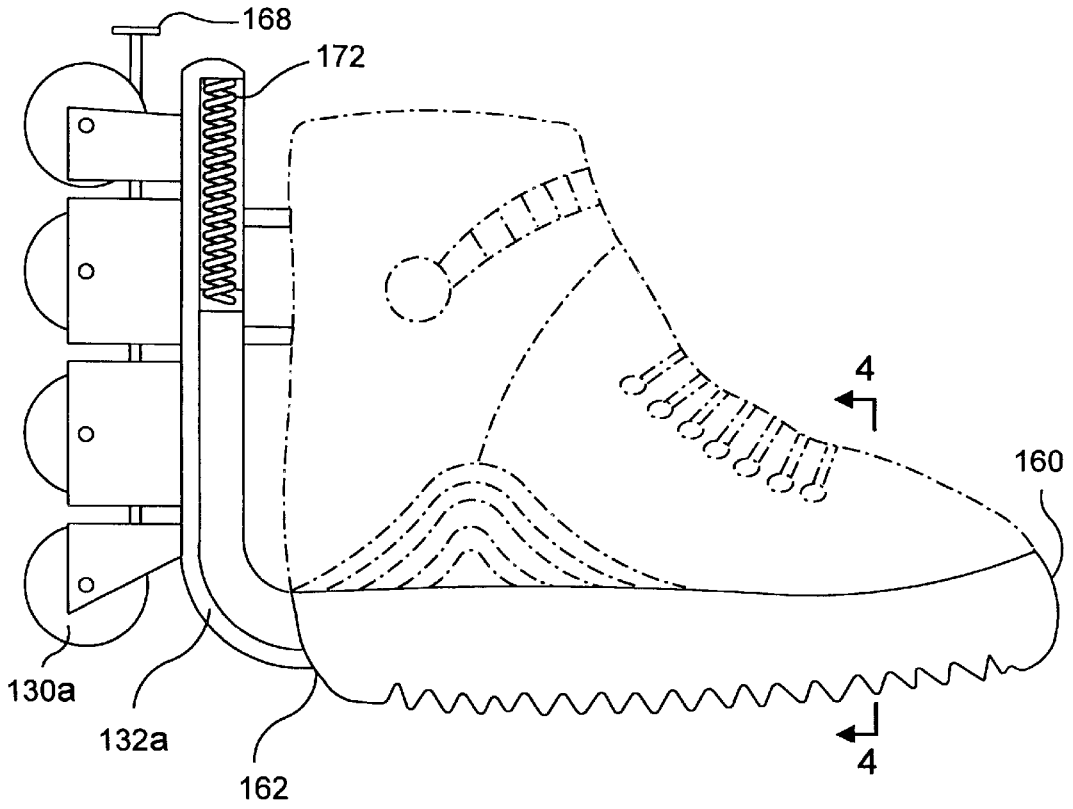
FIG. 3 is a view similar to FIG. 1, with the wheel frame assembly in the stowed position.
Figure 4:
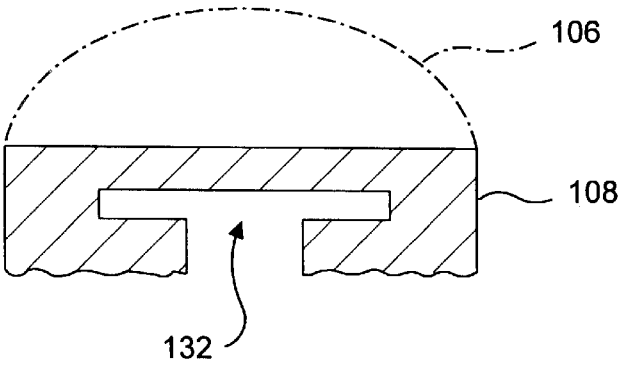
FIG. 4 is a cross-sectional view of FIG. 3, taken along line 4—4.
Figure 5:
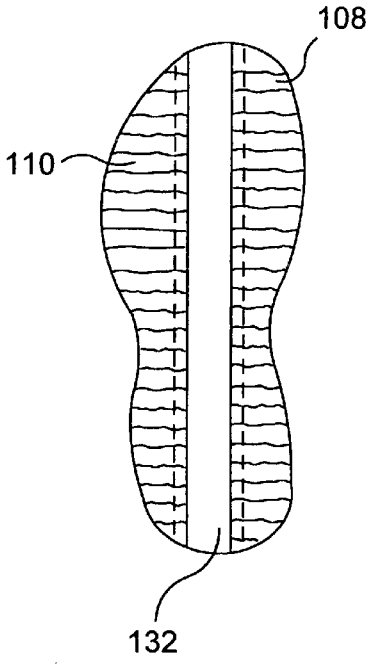
FIG. 5 is a bottom plan view of the shoe portion of FIG. 3.

In a first embodiment of the invention, as shown in FIGS. 1–5, a shoe 102 for an in-line skate 104 is shown. The upper portion 106 of the shoe is generally comparable to those currently in use, while the sole 108 is constructed particularly in accordance with the present invention. The bottom face 110 of the sole 108 is generally flat to allow for walking when the wheel support frame (described below) is not in place. Of course, the bottom face of the sole may have ridges or other relatively minor protrusions and indentations typical of footwear; however, the bottom face is generally free of any rigid protrusions which would interfere with walking.

The sole 108 has a recess in the form of a track 132, here shown with a T-shaped cross-section, running centrally from a point at or near the toe 160 of the shoe, up to and out through the sole at the heel 162 (or curving upwards internally along the back of the shoe, as described below). The space for the track 132 may be simply a recess within the sole portion. Additionally, for improved riding along the track it may be lined with a smooth sliding surface. The sole, particularly in the region surrounding the recess of the track, should be constructed with sufficient rigidity to support the walker when the wheels are not engaged, i.e. are not present in the sole portion. When the track 132*a* exits at the heel of the sole, it continues rearwardly, curving upward along the rear of the shoe towards the top. The rear portion of the track may be either external of the shoe as shown in the drawings, or may be incorporated within an integral rear extension of the shoe in like manner to the construction of the sole. The rear portion 132*a* of the track should extend upwardly to a distance which allows storage of the wheels (see below) while providing sufficient clearance between the last wheel 130*a* and the ground.

At least two aligned wheels are provided on a longitudinal wheel support frame assembly. The frame should be flexible so as to be able to curve along with the curved track. Therefore, it is preferable if each wheel is secured in its own housing 164, with each housing being connected to the adjacent housing by means of a rigid flexible connector 166, such as a wire, to thereby form the frame assembly. Each wheel housing is supported upon a wheel rotatably secured therein. Furthermore, an upper portion 164*a* of the wheel housing is shaped to ride conformingly along the T-shaped track of the sole, while also being supported thereby. It should be clear that the track and wheel housing need not be limited to a T-shape, but rather can be any shape which allows for retaining support of the housing along the track, while not diminishing the integrity of the sole.

When the wheel frame assembly is engaged in the sole in the skating position (FIG. 1), the frame assembly is slid along the track to a forwardmost position towards the toe, until an abutment is reached. A locking means may be provided along any portion of the sole, track or frame assembly to releasably secure the frame assembly in skating position. As described above, any locking means is acceptable, such as a resilient cam and catch means, or spring means, as described with respect to the first embodiment. A similar locking means should also be present to retain the wheel assembly in the stowed position.

The wheel frame assembly is preferably provided with a handle means 168 which may be used to move the assembly along the track to the stowed position on the back 170 of the shoe. Conveniently, the handle means can simply be a rearward extension of the wire equipped with a gripping knob. In addition, it may be advantageous to provide a spring 172 within the rear shoe portion 132*a* of the track, biased in the direction of the sole. In that case, once the wheel frame assembly is released from a locked stowed position, the assembly will spring forward to the engaged position beneath the shoe without further effort from the user.

What is claimed is:

1. An in-line roller skate and shoe combination, comprising a shoe having a sole, the sole having a bottom face which is free of protrusions which would interfere with walking, the sole having at least one recess therein opening downward to the bottom face, said recess forming a longitudinal track running from a region of the sole adjacent a toe end of the sole towards and opening out of a heel end of the sole, the track extending rearwardly from the heel of the sole and curving upwardly along a rear portion of the shoe; and a wheel support frame assembly, comprising at least two in-line wheels each residing rotatably within a wheel housing, an upper portion of each wheel housing being shaped to conform to the track so as to be able to ride along said track while being supportingly retained therein, and flexible linking means for linking the wheel housings to each other.

2. The combination of claim 1, wherein the linking means is a wire.

3. The combination of claim 1, wherein releasable locking means are provided to secure the wheel frame assembly, alternately, in an engaged position and in a stowed position.

4. The combination of claim 1, wherein a spring means is present biasing the wheel frame assembly toward the toe region of the track.

* * * * *